US006137983A

United States Patent [19]

Okabayashi et al.

[11] Patent Number: 6,137,983

[45] Date of Patent: Oct. 24, 2000

[54] FIXING BELT, FIXING APPARATUS EQUIPPED WITH FIXING BELT, AND METHOD OF MANUFACTURING FIXING BELT

[75] Inventors: Eiji Okabayashi, Toyokawa; Mitsuru Isogai, Aichi-Ken; Yuusuke Morigami, Toyohashi, all of Japan

[73] Assignee: Minolta Co., Ltd., Osaka, Japan

[21] Appl. No.: 09/243,468

[22] Filed: Feb. 3, 1999

[30] Foreign Application Priority Data

Feb. 4, 1998 [JP] Japan ..... 10-023303

[51] Int. Cl.[7] ..... G03G 15/20

[52] U.S. Cl. ..... 399/329

[58] Field of Search ..... 198/321, 140, 198/819; 219/216; 430/124, 97, 98; 399/116, 122, 159, 161, 163, 313, 329, 333

[56] References Cited

U.S. PATENT DOCUMENTS

| | | | |
|---|---|---|---|
| 3,498,684 | 3/1970 | Hallaman | 305/38 |
| 3,661,245 | 5/1972 | Mol et al. | 198/193 |
| 4,410,082 | 10/1983 | McGinnis | 198/818 |
| 4,572,359 | 2/1986 | Fujita et al. | 198/819 |
| 5,131,530 | 7/1992 | Rappen | 198/841 |
| 5,345,300 | 9/1994 | Uehara et al. | 219/216 |
| 5,709,949 | 1/1998 | Chen et al. | 428/421 |
| 5,778,294 | 7/1998 | Hiraoka et al. | 399/329 |
| 5,778,295 | 7/1998 | Chen et al. | 399/329 |

FOREIGN PATENT DOCUMENTS

| | | |
|---|---|---|
| 05080666 | 4/1993 | Japan . |
| 06318001 | 11/1994 | Japan . |
| 09204110 | 8/1997 | Japan . |

*Primary Examiner*—William Royer
*Assistant Examiner*—Hoang Ngo
*Attorney, Agent, or Firm*—Burns, Doane, Swecker & Mathis, LLP

[57] ABSTRACT

A fixing belt is applied to a fixing apparatus of an electronic photography type printer. The fixing belt consists of a belt base and an elastic layer having a thickness of 200 μm or more formed on the belt base. The elastic layer consists of first, second and third elastic layers arranged in that order from the base side, and is deformable to conform to the surface shape of a recording paper so that all unfixed toner held on the recording paper can be pressed. The second elastic layer is a barrier layer for preventing releasing agent from permeating and the belt from swelling to suppress the thickening of the elastic layer as a whole and maintain the belt thickness within a range that does not cause any image noises.

19 Claims, 7 Drawing Sheets

FIXING BELT, FIXING APPARATUS EQUIPPED WITH FIXING BELT, AND METHOD OF MANUFACTURING FIXING BELT

This application is based on application No. 10-23303 filed in Japan, the contents of which are hereby incorporated by reference.

BACKGROUND OF THE INVENTION

1. Field of the Invention

The invention is related to a fixing belt used on a fixing apparatus employed on an electronic image forming apparatus such as a printer and a copying machine, and a method for manufacturing the fixing belt.

2. Description of the Related Art

Various electronic image forming apparatuses such as printers and copying machines using electronic photography processes are normally equipped with an apparatus for fixing a toner image formed on a recording medium such as a recording paper and an overhead projector (OHP) sheet. The thermal roller method has been widely used as a fixing method in such apparatuses.

A thermal roller type fixing apparatus generally has a heat roller with a heating source and a pressure roller that is in contact with the heat roller under pressure. Heat and pressure are applied to a recording medium as it passes through the nip area, or the contact area of the rollers, resultantly causing its toner image fixed on the recording medium.

A large amount of toner is applied on a recording medium in case of a fixing apparatus employed on an electronic image forming apparatus, particularly an image forming apparatus that produces a full-color image. Thus, it is preferable to apply heat to a toner image at a temperature as low as possible for a long time for fixing it by securing the nip width or the length of the nip area in a passing direction as wide or long as possible.

However, the nip width of the conventional thermal roller type fixing apparatus depends on the roller diameter and the thickness of a heat-resistant elastic layer formed on the roller. In order to obtain a large nip width, it is necessary to increase the outer diameter of the thermal roller and/or the thickness of the elastic layer. In case of a thermal roller type fixing apparatus for full-color printing, this causes such problems as bulkiness of the apparatus and degrading of thermal conductance, which in turn results in slower printing speeds.

In the meantime, another fixing method has been proposed where a belt is used. The belt type fixing apparatus includes an endless belt and a pressure roller. The nip area in this case is formed as the belt and the pressure roller contact with each other under pressure. The belt type fixing apparatus has an advantage over the thermal roller type in that it can provide a larger nip width easily, thus resulting in a smaller unit with a faster printing capability.

The endless belt is constructed from a base and an elastic layer made of a material such as rubber. The elastic layer is formed on the base for uniformly squashing unmelted toner on the recording medium. For example, JP-A-6-318,001 disclosed a fixing belt including a base made of electric-casting nickel with a thickness of 45 $\mu$m and a silicone rubber layer with a thickness of 50 $\mu$m, as well as a fixing belt including a base made of polyimide resin with a thickness of 55 $\mu$m and a silicone rubber layer with a thickness of 130 $\mu$m.

In the belt type fixing apparatus where pressure and heat are used for fixing, the surface of the recording medium that is holding unfixed toner makes direct contact with the fixing belt, so that a portion of the toner image tends to be transferred to the surface of the rotating member or the fixing belt. Namely, the belt type fixing apparatus has a problem that it has a tendency of causing the offset phenomenon, i.e., the melted toner, which is transferred to the surface of the fixing belt, is transferred back to the trailing edge of the same recording medium or the next medium, thus smearing those recording media. In order to prevent the occurrence of such offset phenomenon, the belt type fixing apparatus has a mechanism that coats a releasing agent on the fixing belt.

The conventional belt type fixing apparatus disclosed by JP-A-6-318,001 has a problem that it is difficult to obtain high quality images with good luster when it is applied to image forming apparatuses intended for full color images. This is due to the fact that deformation produced in the elastic layer of the fixing belt is insufficient for causing the surface of the elastic layer to follow the surface of the recording medium. It is, thus, impossible to squash the entire amount of unmelted toner laid in layers to produce multiple colors.

In order to solve this problem, one alternative solution may seem to be to increase the thickness of the elastic layer of the fixing belt thus increasing the deformation ratio. However, this creates a new problem as follows. As the releasing agent permeates into the elastic layer of the fixing belt, it swells as much as 30%. Since the amount of toner held on the recording medium is large in case of a full color image fixing apparatus, the amount of releasing agent coated on the fixing belt increases as well. As a result, if the elastic layer of the fixing belt is thick, it creates a problem of the elastic layer's swelling in the thickness direction as the releasing agent permeates into it.

For example, in the area where the recording medium passed through, the releasing agent is taken away so that the swelling of the elastic layer reduces, while the elastic layer remains swelled up in the area where the medium did not pass through. It results in creating steps in certain areas of the elastic layer. Consequently, as a large size recording medium is fed immediately following a small size recording medium in case of using a fixing belt having a thick elastic layer, said steps in the elastic layer become more conspicuous and cause fluctuations of the nip area in the width and thickness directions. The matter causes troubles such as density fluctuation, etc.

SUMMARY OF THE INVENTION

An object of the invention is to provide a fixing belt that is capable of following a surface shape of a recording medium to squash all toner and prevent image noises and also is capable of suppressing the swelling of the belt caused by a releasing agent.

Another object of the invention is to provide a method of manufacturing the fixing belt.

One aspect of the invention is an endless fixing belt for an apparatus that fixes an image on a recording medium, which includes a belt-like base made of a metal or plastic material, and an elastic layer with a thickness of 200 $\mu$m or more formed on the base. The elastic layer consists of at least three layers.

Another aspect of the invention is a method of manufacturing a fixing belt, which includes the steps of (a) forming an elastic layer with a thickness of 200 $\mu$m or more formed on a belt-like base made of a metal or plastic material, (b) cutting off edges of the base and the elastic layer wherein the edges are in a width direction thereof, and (c) forming barrier sections to cover cut-off surfaces on the edges.

Another aspect of the invention is an endless fixing belt for an apparatus that fixes an image on a recording medium, which includes a belt-like base made of a metal or plastic material, an elastic layer formed on the base, and guides formed on edges of the belt in a width direction thereof to correct snaking motions of the belt.

Another aspect of the invention is a fixing apparatus, which includes a plurality of rollers, an endless fixing belt that spans the rollers, and members that form a nip area to apply pressure to an outer surface of the fixing belt. The fixing belt includes a belt-like base made of a metal or plastic material, and an elastic layer with a thickness of 200 $\mu$m or more being formed on the base and consisting of at least three layers.

The objects, characteristics, and advantages of this invention other than those set forth above will become apparent from the following detailed description of the preferred embodiments, which refers to the annexed drawings.

DETAILED DESCRIPTION OF THE INVENTION

The embodiments of this invention will be described below with reference to the accompanying drawings.

Embodiment 1

Figure 1:
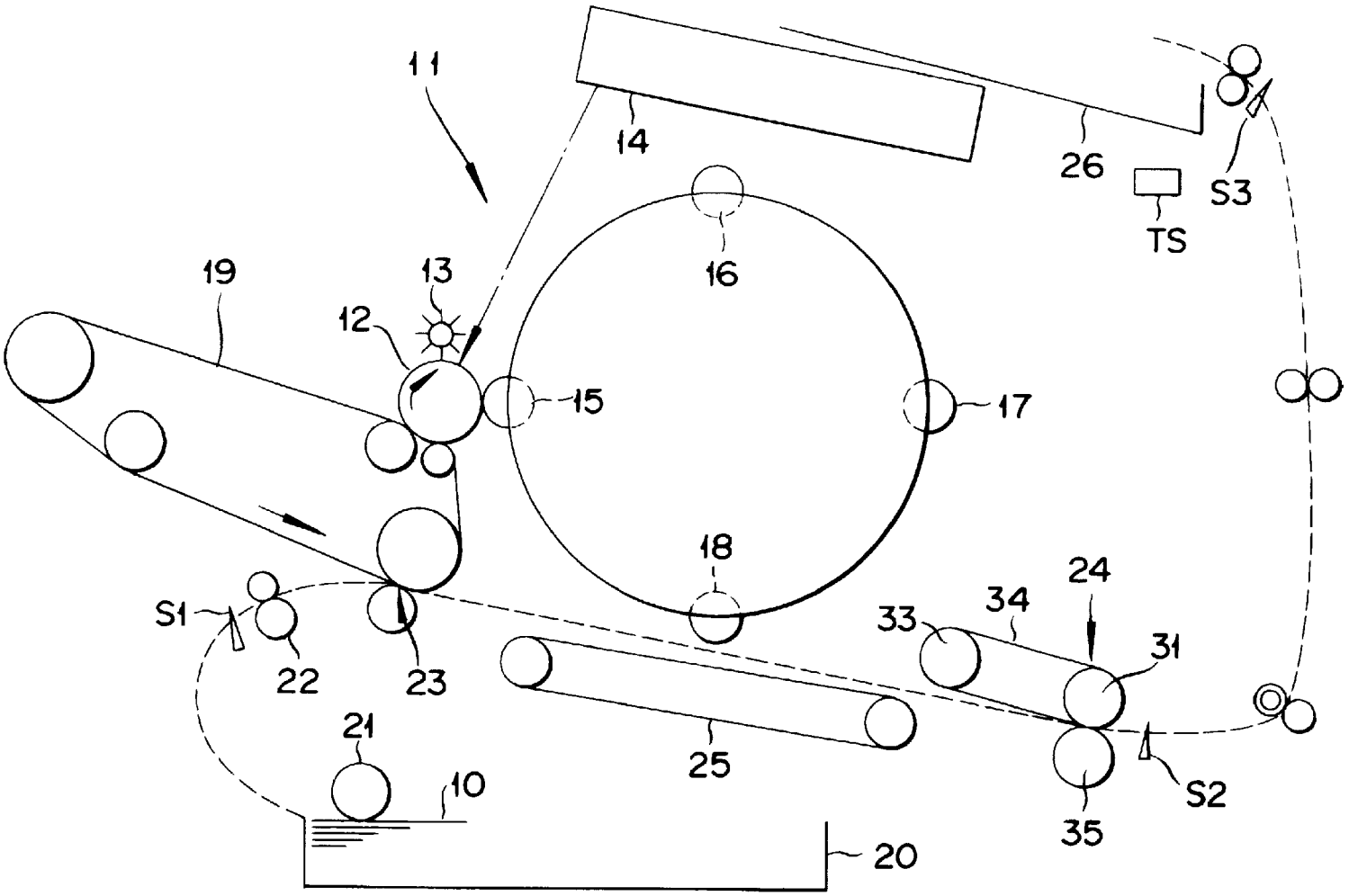
FIG. 1 is a schematic cross section of a printer to which this invention is applied.

Let us describe the general structure of an electrophotographic type full color printer to which the present invention is applied referring to FIG. 1.

The printer 11 includes a photoconductor drum 12, which is an image carrying member and rotates in the direction of the arrow shown in the drawing, a laser generator 14, an electric charging device 13 placed in the vicinity of the photoconductor drum 12 to charge the periphery of the photoconductor drum 12, a developing device equipped with first through fourth developing units 15, 16, 17, and 18, a transferbelt 19, acleaningdevice (not shown) for removing residual toner on the photoconductor drum 12, and a sensor TS that detects the temperature inside the printer 11.

The laser generator 14 drives as well as modulates a semiconductor laser depending on the level of image signals received from an external device such as a computer (not shown). The laser light travels through a light path including a polygon mirror, an f-θ lens, and a reversing mirror, all of which are not shown in the drawing, and is irradiated on the surface of the photoconductor drum 12 located between the electric charging device 13 and the developing device.

The toner image in full colors is formed as follows.

First, a first electrostatic latent image is formed on the photoconductor drum 12 by means of the irradiation of the laser light. The first electrostatic latent image is developed into a visible yellow toner image by the first developing unit 15. The yellow toner image is held on the transfer belt 19 that moves in the direction of the arrow shown in the drawing. Next, a second electrostatic latent image is formed on the photoconductor drum 12. The second electrostatic latent image is developed into a visible magenta toner image by the second developing unit 16. The magenta toner image is overlaid on top of the yellow toner image on the transfer belt 19. Similarly, a third electrostatic latent image formed on the photoconductor drum 12 is developed into a visible cyan toner image by the third developing unit 17. The cyan toner image is overlaid on the toner image of the transfer belt 19. Therefore, a full color image is obtained. A black toner is contained in the fourth developing unit 18. When a monochromatic print is specified, an electrostatic latent image formed on the photoconductor drum 12 is developed into a visible monochrome image by means of the fourth developing unit 18.

A paper cassette 20 is detachably mounted on the printer main body. The paper cassette 20 contains a plurality of sheets 10 of recording medium, or recording paper. The sheet 10 is fed one sheet at a time by means of a paper feed roller 21, synchronized with the toner formation by means of a timing roller 22, and is transported to a transfer area 23. The full color toner image held on the transfer belt 19 is transferred to the sheet 10 in the transfer area 23. This forms an unfixed image on the sheet 10. The sheet 10 is then separated from the transfer belt 19 and fed by means of the feed belt 25 to a fixing device 24. The toner transferred to the sheet 10 is then melted and fixed by the fixing device 24. After the toner is fixed, the sheet 10 is outputted to a discharge tray 26. The fixing device 24 is built as a belt system, which will be explained later.

When the transfer of the toner image to the sheet 10 is completed, the remaining toner on the photoconductor drum 12 is removed by the cleaning device, and the remaining electric charge on the photoconductor drum 12 is removed by an eraser. The photoconductor drum 12 is then charged again by the electric charging device 13, a latent image is formed by the laser light, and the latent image is developed by the developing units 15 through 18.

A plurality of sensors S1, S2, and S3 are arranged along the sheet feed path to detect the leading and/or trailing edge of the sheet 10. The control timing of each part of the printer is based on the detection signals of the sensors S1, S2, and S3.

All members related to the sheet feed path such as the feed belt 25 and the timing roller 22, members related to the image forming system such as the transfer belt 19, the photoconductor drum 12, and moving members such as the drive roller of the fixing device are driven by a power transmission mechanism including a motor as a driving source (not shown), gears and pulleys (all of them not shown), so that the sheet feed speed and the rotating speed and transport speed of these various members are all synchronized.

Figure 2:
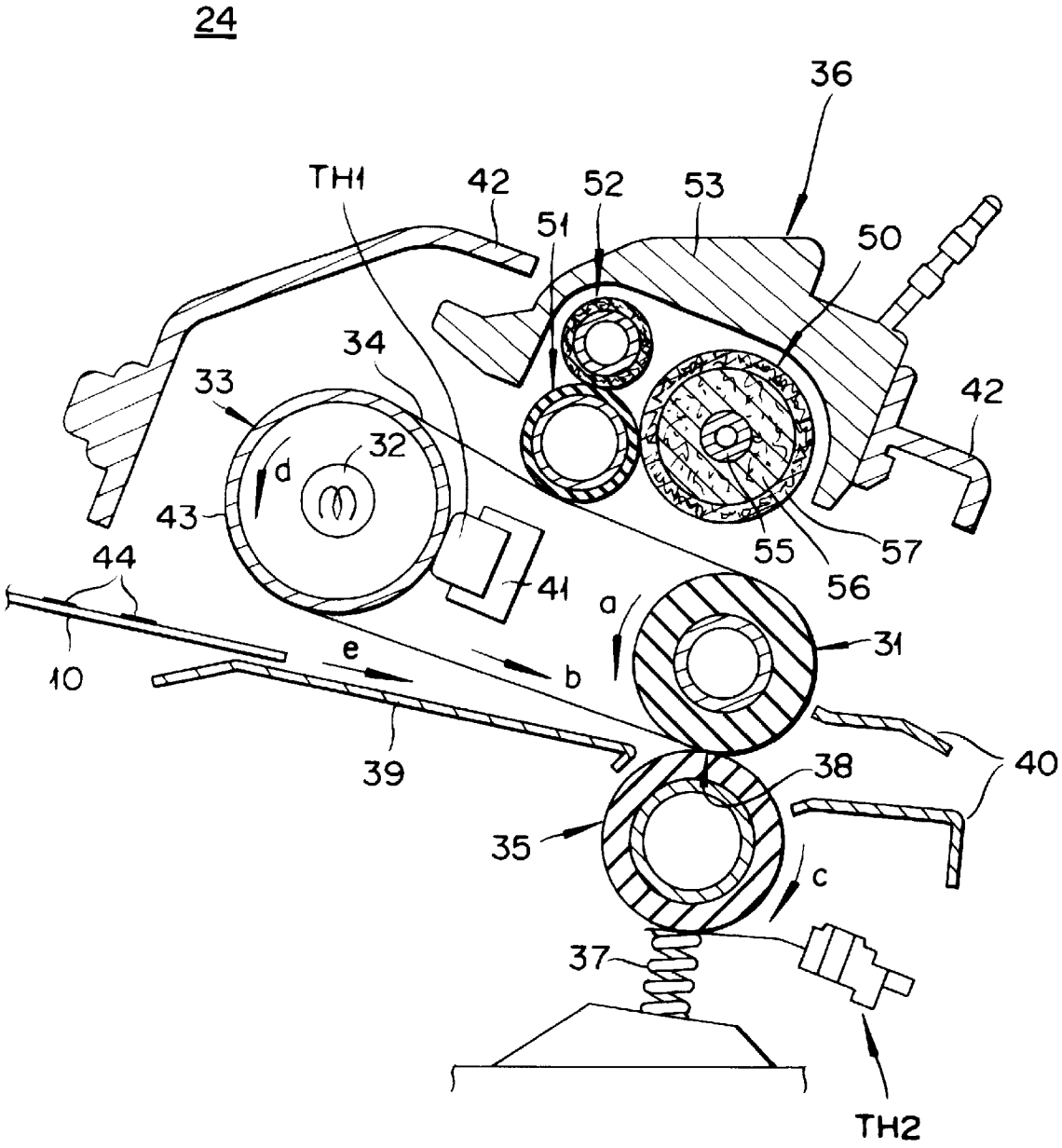
FIG. 2 is a cross section of a fixing apparatus used in the printer shown in FIG. 1.

Next, let us describe the general structure of the fixing device 24 referring to FIG. 2.

The belt type fixing apparatus 24, as shown in the drawing, includes a drive roller 31 capable of rotating in an arrow "a", a heat roller 33 containing a halogen lamp (heat source) 32 that functions as a heater, a fixing belt 34 that spans between the drive roller 31 and the heat roller 33, a pressure roller (pressuring member) 35 making contact with a drive roller 31 under pressure via the fixing belt 34, and a coating unit 36 that coats the outer surface of the fixing belt 34 with releasing agent to prevent offset phenomena. The releasing agent is, for example, silicone oil.

The outer surface of the fixing belt 34 forms a nip area for the toner on the sheet being transported to be fixed on the sheet by means of the pressure roller 35 contacting it under pressure. The fixing belt 34 is an endless belt having a belt base and an elastic layer formed on the base as described in detail later.

One end of the driving roller 31 has a drive gear (not shown) affixed thereto. The drive roller 31 is driven in the direction of an arrow "a" by means of a drive source such as a motor, which is connected to the drive gear, and makes a contact with the back side of the fixing belt 34 to drive the fixing belt 34 in the direction of an arrow "b." In order to drive the fixing belt 34 securely, the periphery of the drive roller 31 is covered with a material of a high friction coefficient, e.g., silicone rubber, to prevent slips between itself and the fixing belt 34. Moreover, it is preferable that the material that is covering the periphery of the drive roller 31 is made of a material of a relatively low hardness such as silicone sponge for forming a desired nip width. The motor that drives the drive roller 31 is also a drive power source for various rotating members and feed members of the printer as stated above. Therefore, the speed of the drive roller 31 is synchronized with the motions of these members and change in accordance with the change of the motor speed.

The heat roller 33 is made of a hollow metallic roller and is provided with the halogen lamp 32, which serves as a heater, on the center axis thereof. As a heat source, other means such as a resistance heater or an electromagnetic induction heater can be used in place of the halogen lamp 32. It is preferable that the heat roller 33 is made of a material of a high thermal conductivity such as aluminum and copper so that heat can be supplied efficiently to the fixing belt 34.

The pressure roller 35 is made of a metallic pipe whose periphery is covered with silicone rubber or fluorocarbon resin, is urged by a spring 37, and is contacting the drive roller 31 under pressure via the fixing belt 34. When the fixing belt 34 moves toward the arrow "b" with the rotation of the drive roller 31, the pressure roller 35 is driven in the direction of an arrow "c" due to the friction between itself and the fixing belt 34.

The surface hardness of the drive roller 31 and that of the pressure roller 35 are set to satisfy the following relation:

$$X \geqq Y$$

in which X and Y represent the surface hardness of pressure roller 35 and the surface hardness of drive roller 31, respectively.

This is set so that the sheet 10, after the toner has been fixed, can be smoothly discharged from the nip area 38 between the pressure roller 35 and the fixing belt 34. In other words, by setting the relation in such a way that the pressure roller 35 can indent the drive roller 31 slightly via fixing belt 34, the sheet 10 moves away from the parallel direction or the circumference of the drive roller 31.

A guide plate 39 is provided below the fixing belt 34 in order to guide the sheet 10, which is holding unfixed toner, without causing it to touch the fixing belt 34 to the nip area 38. A discharge guide 40 is provided on the downstream side of the nip area 38.

A first temperature sensor TH1 is provided inside of the fixing belt 34 in order to detect the temperature of the heat roller 33. A second temperature sensor TH2 is provided contacting the pressure roller 35 in order to detect the temperature of the pressure roller 35. The first and second temperature sensors TH1 and TH2 are both including a thermister and detect the temperatures of the heat roller 33 and the pressure roller 35 respectively by making contacts with their surfaces. The first temperature sensor TH1 is held by a support 41 placed relative to the rotating axis of the heat roller 33, so that the positional relation relative to the heat roller 33, or the contact conditions, therewith can be maintained constant.

The coating unit 36 is placed above the fixing belt 34 and includes a coating roller 50 holding releasing agent therein to be coated on the surface of the fixing belt 34, a transfer roller 51 contacting with the surface of the coating roller 50 to coat releasing agent supplied by the coating roller 50 on the outer surface of the fixing belt 34, a cleaning roller 52 contacting with the surface of the transfer roller 51 to remove paper dust and toner from the transfer roller 51, and a holder 53 holding these roller 50, 51, and 52 rotatably.

A transfer roller 51 is providing a proper tension to the fixing belt 34 by contacting, between the drive roller 31 and the heat roller 33, under pressure with the fixing belt 34 that runs from the drive roller 31 toward the heat roller 33. This stabilizes the running of the fixing belt 34 as well as the releasing agent coating action of the transfer roller 51 to the fixing belt 34.

The coating roller 50 constitutes a multiple layer structure including a core metal 55, an oil holding layer 56 formed on the surface of the core metal 55, and a surface layer 57 formed on the outside of the oil holding layer 56. The transfer roller 51 includes a core metal, and a cover layer made of silicone rubber which has a good affinity with releasing agent. The cover layer is formed on the surface of the core metal. The cleaning roller 52 includes a core metal, and a cover layer formed on the surface of the core metal. This cover layer is made of a material having a higher affinity with toner than silicone rubber, such as felt. The transfer roller 51 has a higher surface roughness than the fixing belt 34 so that it can collect the contaminants from the fixing belt 34. The cleaning roller 52 has an even higher roughness than the transfer roller 51 so that it can collect the contaminants from the transfer roller 51.

The coating unit 36 is detachable from a frame 42 of the fixing device 24. When releasing agent retained inside the coating roller 50 is used up, the used coating unit 36 is removed from the frame 42, and a new coating unit 36 is attached to the frame 42. The cleaning roller 52 can be replaced by a cleaning pad contacting the surface of the transfer roller 51. Moreover, the coating roller 50 can be made to contact directly with the fixing belt 34.

Next, let us describe the action of the fixing device 24.

When the motor is started, the drive roller 31 rotates in the direction of the arrow "a" and the fixing belt 34 runs in the direction of arrow "b." As the fixing belt 34 runs, the heat roller 33 and the pressure roller 35 rotate in the diretions of an arrow "d" and the arrow "c" respectively. After being coated with releasing agent at an upstream position of the heat roller 33, the fixing belt 34 is heated to a desired temperature by the heat from the halogen lamp 32 in the contact area (heating area 43) with the heat roller 33, and further travels above the guide plate 39 into the nip area 38 between itself and the pressure roller 35.

The sheet 10 that is holding unfixed toner 44 on the side that is to contact with the fixing belt 34 is fed toward the nip area 38 guided by the guide plate 39 along the direction of an arrow "e." As they are being fed, the sheet 10 and unfixed toner 44 are both heated by radiation from the fixing belt 34, which is facing them apart a desired distance. The unfixed toner 44 on the sheet 10 is properly softened by this preheating.

As the sheet 10 is further fed, it enters the nip area 38. While it is being fed through the nip area 38, the sheet 10 is sufficiently heated due to heat transferred from the contacting fixing belt 34, and is pressed by the pressure roller 35 and the drive roller 31. In other words, the toner 44 held on the sheet 10 is sufficiently heated to melt and pressed to be fixed on the sheet 10. The toner transfer to the fixing belt 34, or offset phenomenon, is suppressed by the releasing agent coated on the surface of the fixing belt 34.

After having passed through the nip area 38, the sheet 10 separates naturally from the fixing belt 34 and is fed toward the discharge tray 26 (refer to FIG. 1). The amount of heat taken away from the fixing belt 34 due to its contact with the sheet 10 is replenished by the halogen lamp 32 under a desired temperature control.

Since the fixing belt 34 is heated after the coating of releasing agent, the temperature is stable assuring good toner fixing. The tension provided to the fixing belt 34 by means of the transfer roller 51 contributes to the suppression of running fluctuations or irregular movements of the belt. Therefore, the fixing belt 34 runs smoothly and uniformly, achieving a longer service life.

Moreover, contamination of the fixing belt 34 due to paper dust, toner and the like is transferred to the cleaning roller 52 via the transfer roller 51, which contacts with the fixing belt 34, contamination of the coating roller 50 can be reduced. Consequently, the releasing agent is supplied to the transfer roller 51 by the coating roller 50 evenly and uniformly, and is coated on the fixing belt 34 evenly and uniformly by the transfer roller 51. As shown in the above, since the offset is securely prevented and the fixing belt 34 is cleaned, image fixing of high quality can be obtained.

Figure 3:
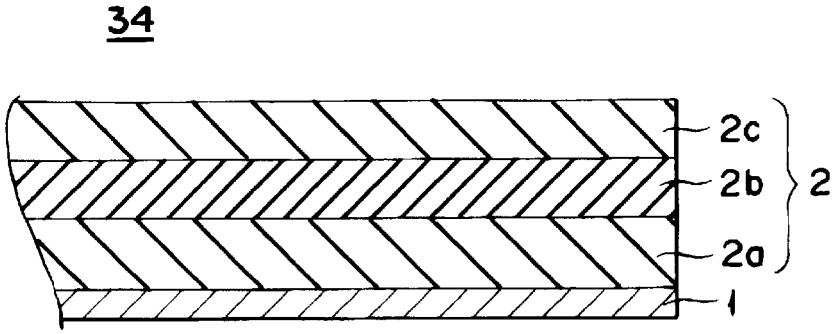
FIG. 3 is a cross section of a fixing belt according to Embodiment 1.

Next, let us describe the structure of the fixing belt 34 referring to FIG. 3.

The fixing belt 34 is an endless belt including a belt base 1 made of a metal such as carbon steel, stainless steel and nickel or a heat resistant plastic material, and an elastic layer 2 formed on the belt base 1. The fixing belt 34 preferably has a seamless structure.

For example, the thickness of the belt base 1 is approximately 40 μm and the thickness of the elastic layer 2 is more than approximately 200 μm. This is because the thickness of the elastic layer 2 is required to be more than approximately 200 μm in order for the elastic layer 2 to conform to the surface shape of the sheet in consideration of the fact that the surface roughness of the sheet 10 made of paper is approximately 10 μm and the deformation ratio of the elastic layer 2 is approximately 5%, which is dependent on the rubber hardness and the contact force in the nip area.

Figure 4A:
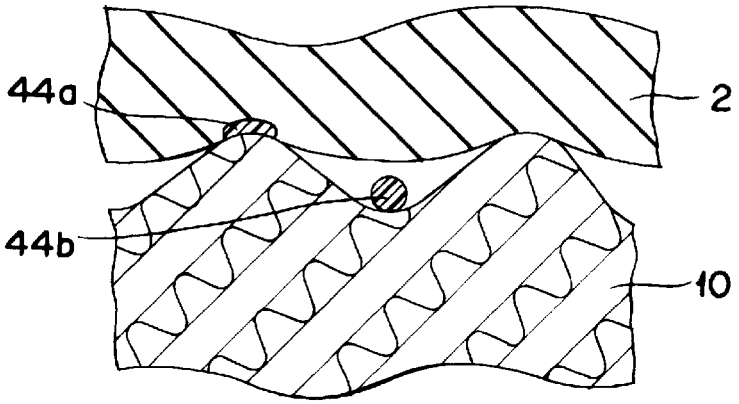
FIG. 4A and FIG. 4B are a cross section of an elastic layer of the fixing belt showing a case wherein its deformation is insufficient as well as a case wherein its deformation is sufficient respectively for squashing toner on a sheet by the belt.
Figure 4B:
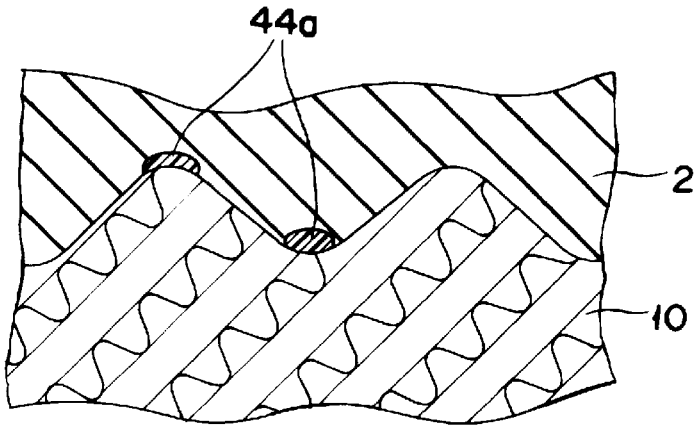

For example, if the thickness of the elastic layer 2 is 100 μm and its deformation amount is insufficient, melted and squashed toner 44*a* and unmelted particulate toner 44*b* coexist on the sheet 10 as shown in FIG. 4A. Therefore, images tend to have appearances of uneven and poor qualities. This tendency is more conspicuous in the half-tone area (where the toner spreads out thin on the sheet 10). On the other hand, if the thickness of the elastic layer 2 is 200 μm and an appropriate amount of deformation is obtained, the elastic layer conforms to the surface shape of the sheet squashing all toner held on the sheet as shown in FIG. 4B. Therefore, all toner become melted toner 44*a*, so that images of uniform and excellent qualities can be obtained.

The elastic layer 2 consists of a first elastic layer 2*a*, a second elastic layer 2*b* and a third elastic layer 2*c* arranged in that order from the belt base 1. The second elastic layer 2*b* is a barrier layer made of fluorine-containing rubber capable of resisting permeation of the releasing agent. However, the material of the second elastic layer 2*b* is not limited to it, but can be any material as long as it does not allow the releasing agent from permeating. On the other hand, the third elastic layer 2*c* is made of silicone rubber having a good affinity to silicone oil used as a releasing agent, heat resistance, and a good releasing characteristic against toner. The first elastic layer 2*a* is made of silicone rubber similar to the third elastic layer 2*c*. The first elastic layer 2*a* and the third elastic layer 2*c* can be formed of other elastic materials in place of silicone rubber.

With such a structure, the releasing agent coated by the coating unit 36 on the outer surface of the fixing belt 34, or the outer surface of the third elastic layer 2*c*, can be prevented from permeating into the first elastic layer 2*a* by being blocked by the second elastic layer 2*b*. Consequently, the range that swells due to the existence of the releasing agent is substantially limited to the third elastic layer 2*c* and the first elastic layer 2*a* does not experience any swelling. Therefore, it is possible to minimize the increase of the thickness of the elastic layer 2 as a whole.

Moreover, the thickness of the first elastic layer 2*a* is chosen to be thicker than that of the third elastic layer 2*c*. Consequently, while the swelling of the first elastic layer 2*a* due to the releasing agent is effectively prevented by the barrier characteristic of the second elastic layer 2*b*, the outer surface of the elastic layer 2 can still provide a sufficient deformation ratio to conform to the surface shape of the sheet 10 that is holding unfixed toner.

Figure 5A:
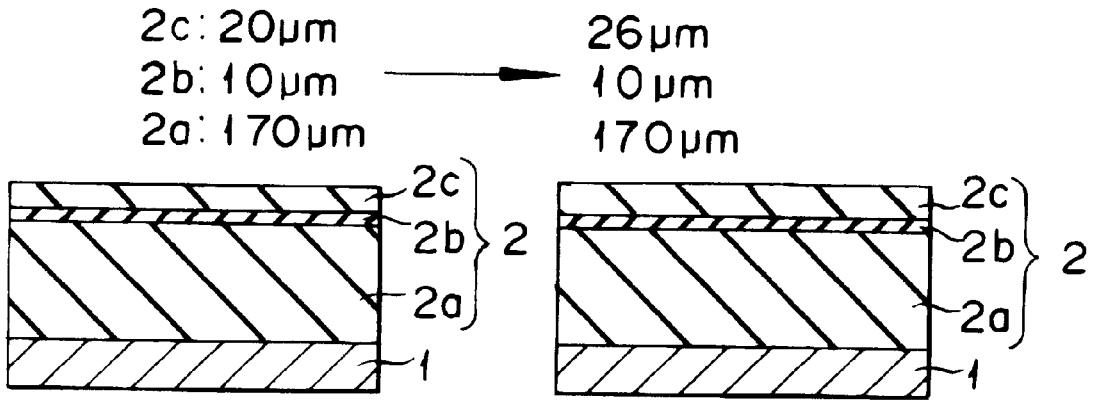
FIG. 5A and FIG. 5B are a cross section of the elastic layer according to Embodiment 1 is swelling due to releasing agent and a cross section consisting only of silicone rubber is swelling due to releasing agent respectively.
Figure 5B:
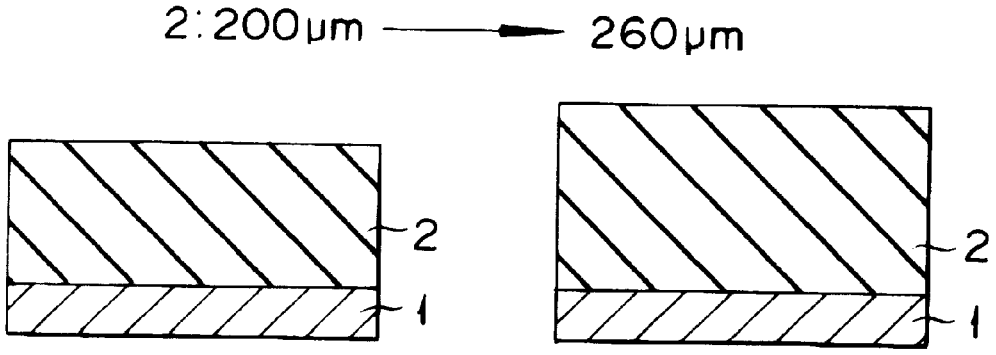

For example, as shown in FIG. 5A, if a releasing agent made of silicone oil is applied to an elastic layer 2 consisting of a first elastic layer 2*a* made of silicone rubber with a thickness of 170 μm, a second elastic layer 2*b* made of fluorine-containing rubber with a thickness of 10 μm, and the third elastic layer 2*c* with a thickness of 20 μm, only the third elastic layer 2*c* swells approximately 30%, i.e., to 26 μm. However, the increase of the thickness of the elastic layer as a whole is held within about 3%. On the other hand, if a releasing agent consisting of silicone oil is coated on an elastic layer 2 consisting of a 200 μm thick silicone rubber as shown in FIG. 5B, the elastic layer 2 swells approximately 30% to result in a thickness of 260 μm.

Therefore, it is possible to retain a deformation ratio suitable for conforming to the surface shape of the sheet by improving the deformation characteristic under nipping pressure by means of increasing the thickness of the elastic layer 2 so that all toner held on the sheet can be pressed.

Furthermore, it is preferable to use a first elastic layer 2*a* made of a material with a higher heat conductivity in order to minimize the reduction of heat conductance due to the increase of the belt thickness as described above. Such a material can be obtained by adding aluminum oxide or magnesium oxide to silicone rubber.

As aforesaid, the fixing belt according to the Embodiment 1 includes a belt base 1 made of metal or plastic and an elastic layer 2 with a thickness of 200 μm formed on the belt base, wherein the elastic layer 2 consists of first, second and third elastic layers, 2*a*, 2*b* and 2*c*, arranged in that order from the belt base side, and the second elastic layer 2*b* is made of fluorine-containing rubber that prevents releasing agent from permeating to serve as a barrier layer.

As a result, the swelling of the belt can be prevented as the second elastic layer 2*b* serves as a barrier to prevent the releasing agent coated on the outer surface of the third elastic layer 2*c* from permeating into the first elastic layer 2*a*, even if the elastic layer 2 is thickened to allow it to conform to the surface shape of the sheet so that all toner held on the sheet can be effectively squashed. Consequently, the belt thickness can be held within a range that does not cause any image noises by preventing the thickening of the elastic layer as a whole.

The second elastic layer 2*b* according to the Embodiment 1 is constituted of a barrier layer made of fluorine-containing rubber that prevents the permeation of the releasing agent. However, the present invention is not limited to such a constitution but rather it allows any elastic layer 2 with a thickness of at least 200 μm consisting of at least three layers. For example, a material that allows a small amount of releasing agent permeation but is capable of holding the swelling within a desired limit is applicable as the second elastic layer 2*b*.

Embodiment 2

Figure 6:
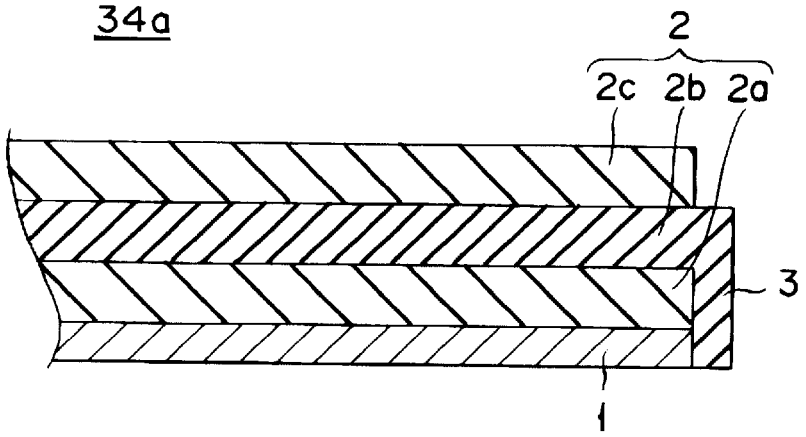
FIG. 6 is a cross section of a fixing belt according to Embodiment 2.

A fixing belt 34*a* shown in FIG. 6 is different from that of the Embodiment 1 is that the former has an edge barrier section 3. The edge barrier section 3 is formed in such a way as to cover the edges of the belt width direction of the first elastic layer 2*a*.

In this constitution, the releasing agent coated on the outer surface of the third elastic layer 2*c* is prevented from reaching the first elastic layer 2*a* via the edges of the belt width direction of the second elastic layer 2*b*. This enhances the preventive effect against belt swelling.

Figure 7:
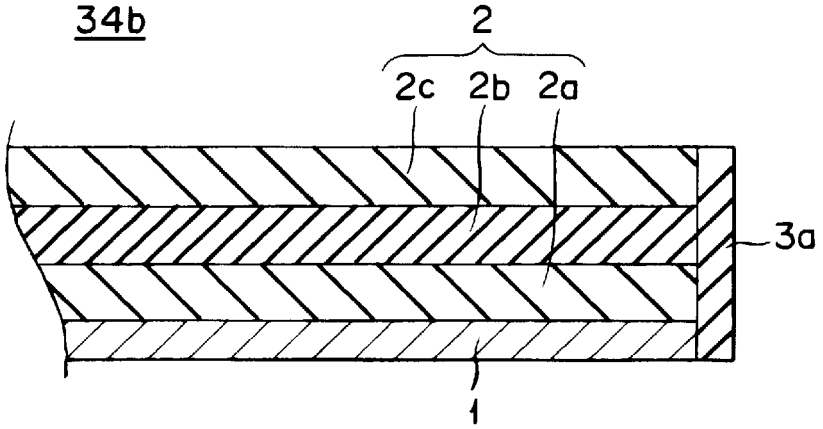
FIG. 7 is a cross section showing a modification of the fixing belt shown in FIG. 6.

It suffices the purpose of the edge barrier section 3 if it covers the edges in the width direction of the first elastic layer 2*a* of the elastic layer 2. For example, as shown in FIG. 7, the edge barrier section 3*a* can be formed to cover the entire edges in the belt width direction of the fixing belt 34*b*. By doing so, the releasing agent coated on the outer surface of the third elastic layer 2*c* can be more completely prevented from reaching the first elastic layer 2*a*, thus suppressing the belt swelling better.

Figure 8:
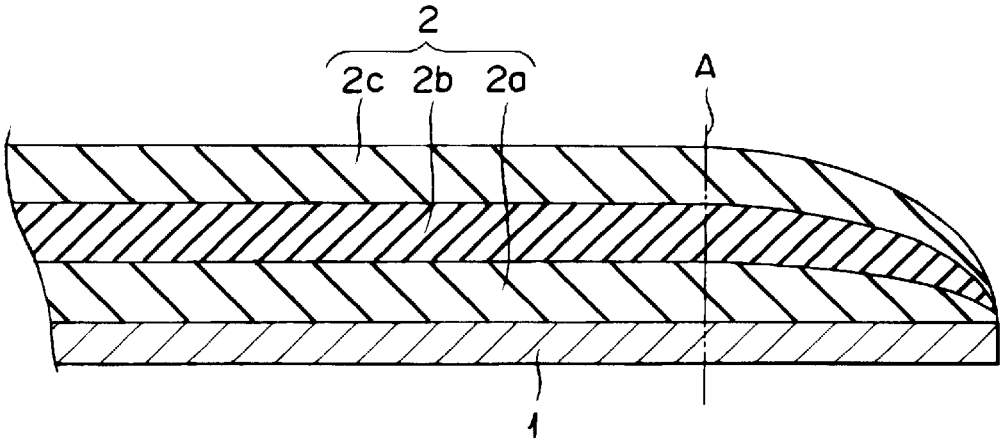
FIG. 8 is a cross section for describing a method of manufacturing the fixing belt show in FIG. 7.

Next, in reference to FIG. 8, let us describe the method of manufacturing the fixing belt 34*b* shown in FIG. 7.

To begin with, an elastic layer 2 with a thickness of at least 200 μm consisting of first, second and third elastic layers, 2*a*, 2*b* and 2*c*, formed in that order from the belt base side on a belt base 1 made of metal or plastic. Next, a portion of the edges of the belt base 1 and the elastic layer 2 is cut off along the double-dotted chain line A shown in the drawing. Lastly, the edge barrier section 3*a* is formed to cover the edges in the belt width direction.

Generally speaking, when the first, second and third elastic layers 2*a*, 2*b* and 2*c*, are formed in that order from the belt base 1 side on a belt base 1, the belt width direction edges tend to produce drooping as shown in the drawing. It prevents the second elastic layer 2*b* from providing the aforementioned barrier function against the releasing agent sufficiently. However, the manufacturing method disclosed here can easily form without fail a barrier layer that can prevent the releasing agent coated on the outer surface of the third elastic layer 2*c* from going around the edges.

Embodiments 3 to 6

Each of fixing belts 34*c* through 34*f* shown in FIGS. 9A through 9D includes a belt base 1 made of metal or plastic, an elastic layer 2 formed on the belt base 1, and a guide 4 that is formed on the edges in the belt width direction to correct snaking motions by means of abutting with abutment members. The guide 4 is made of an elastic material such as fluorine-containing rubber that has heat resistance but only a limited affinity against releasing agent.

Figure 9A:
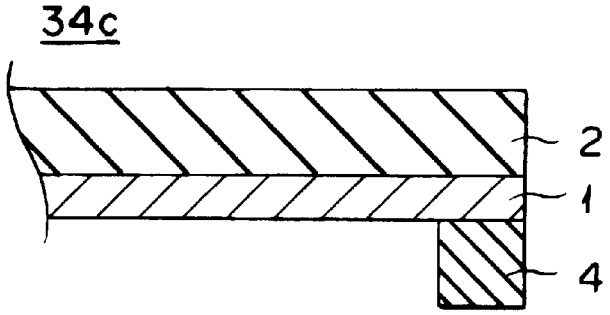
FIGS. 9A through 9D are cross sections of fixing belts according to Embodiments 3 through 6.
Figure 9B:
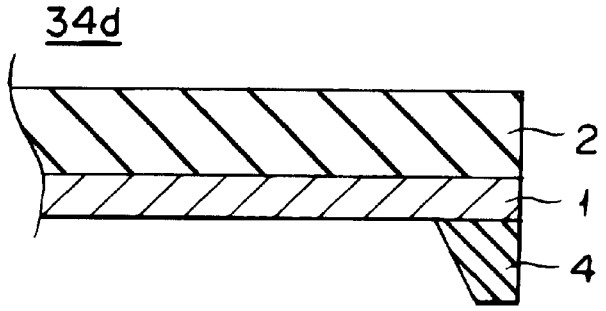
Figure 9C:
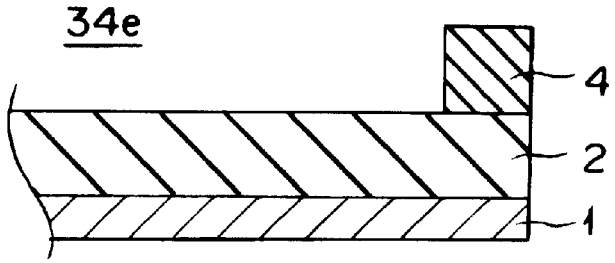
Figure 9D:
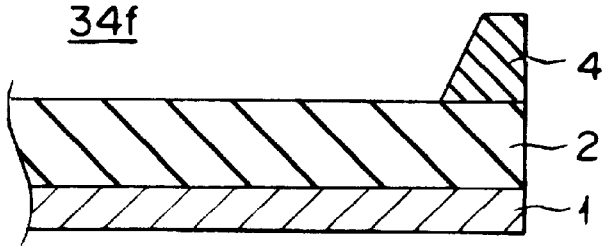

If the guide 4 is formed on the inside of the fixing belt 34*c* or 34*d* as shown in FIGS. 9A and 9B, a rotatable roller which functions as an abutment member must be arranged inside of the belt. However, if the heat roller 33 can be used as such an abutment member. If the cross section of the guide 4 is tapered as shown in FIG. 9B, it makes it easier to install the fixing belt on the rollers and saves the material cost as well. If the guide 4 is to be formed on the outside of the fixing belt 34*e* or 34*f* as shown in FIGS. 9C and 9D, it is necessary to arrange a rotatable roller which functions as an abutment member on the outside of the belt.

In general, the fixing belts 34*c* through 34*f*, tend to move away from the centers of the rollers toward one side due to imbalances of pressures in the axial direction or misalignments of the shafts of the drive rollers 31 and the pressure roller 35 which are pressed together via the fixing belts 34*c* through 34*f*.

The guide 4 used in the embodiments 3 to 6 prevents such offsetting motions of the belt. Therefore, it prevents tangential or snaking motions of the belt and stabilizes the fixing belt running.

Embodiment 7, 8

Figure 10A:
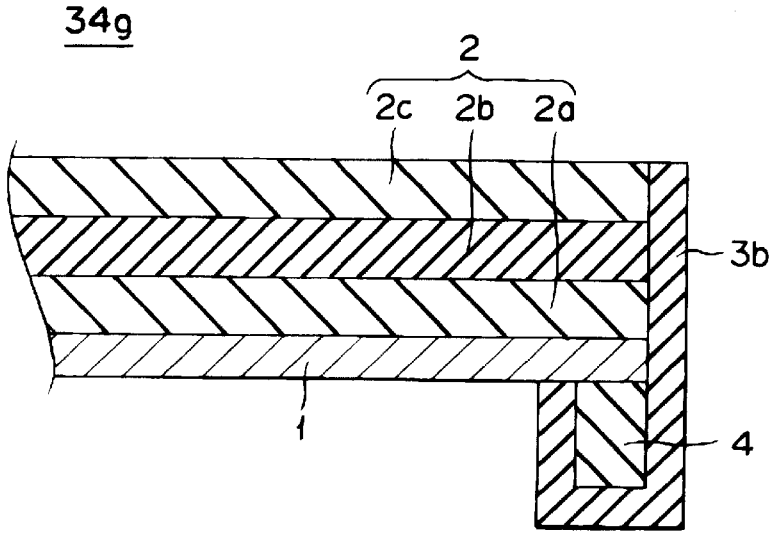
FIGS. 10A and 10B are cross sections of fixing belts according to Embodiments 7 and 8.
Figure 10B:
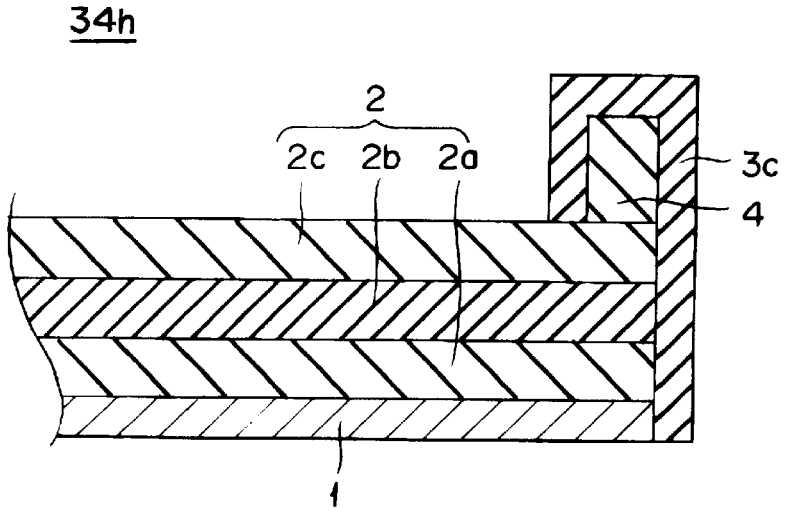

Each of fixing belts 34*g* and 34*h* shown in FIGS. 10A and 10B includes an elastic layer 2 composed of first, second and third elastic layers 2*a*, 2*b* and 2*c*, formed in that order from the belt base 1, a guide 4 to correct snaking motions, and edge barrier sections 3*b* and 3*c* formed to cover the entire edges in the belt width direction as well as the guide 4. The second elastic layer 2*b* is made of a material such as fluorine-containing rubber that prevents the permeation of the releasing agent. It is not necessary for the edge barrier sections 3*b* and 3*c* to cover the entire edges in the width direction of the belt, but rather it is acceptable as long as it is formed to cover at least the edges in the width direction of the first elastic layer 2*a* of the elastic layer 2 and the surface of the guide 4.

The embodiments 7 and 8 prevent tangential or snaking motions of the fixing belt during its run, and simultaneously suppresses the thickening of the elastic layer as a whole as it prevents swelling of the belt, so that they contain the belt thickness within a certain range for preventing image noises.

It is obvious that this invention is not limited to the particular embodiments shown and described above but may be variously changed and modified by any person of ordinary skill in the art without departing from the technical concept of this invention.

For example, it is possible, in the fixing belts shown in FIG. 10A and FIG. 10B, to form the snaking motion correcting guide 4 with an elastic material having a heat resistance and a limited affinity against the releasing agent. In such a case, the edge barrier sections 3*b* and 3*c* need not to cover the surface of the guide 4, so that they have simpler structures and can be manufactured more economically.

What is claimed is:

1. An endless fixing belt for an apparatus that fixes an image on a recording medium, the fixing belt comprising:

a belt-like base made of a metal or plastic material; and an elastic layer with a thickness of 200 μm or more formed on said base, said elastic layer comprising at least three layers.

2. A fixing belt according to claim 1, in which said elastic layer consists of first, second and third elastic layers arranged in that order from the base, the second layer made of a material that prevents permeation of releasing agent.

3. A fixing belt according to claim 2, in which the second elastic layer is made of fluorine-containing rubber.

4. A fixing belt according to claim 2, in which the first elastic layer has a greater thickness and a higher thermal conductivity than the third elastic layer.

5. A fixing belt according to claim 2, further comprising barrier sections formed to cover edges of at least the first elastic layer among said elastic layers, the edges being in a width direction thereof.

6. A method of manufacturing a fixing belt, comprising the steps of:

(a) forming an elastic layer with a thickness of 200 μm or more formed on a belt-like base made of a metal or plastic material;

(b) cutting off edges of the base and the elastic layer, the edges being in a width direction thereof; and (c) forming barrier sections to cover cut-off surfaces on the edges.

7. A method according to claim 6, in which the elastic layer consists of first, second and third elastic layers arranged in that order from the base, and the barrier sections are formed to cover edges of the first elastic layer, the edges being in a width direction thereof.

8. An endless fixing belt for an apparatus that fixes an image on a recording medium, the fixing belt comprising:

a belt-like base made of a metal or plastic material;

an elastic layer with a thickness of 200 μm or more formed on said base; and guides formed on edges of said belt in a width direction thereof to correct snaking motions of said belt.

9. A fixing belt according to claim 8, in which said guides are formed on a surface of said base opposite to a surface where said elastic layer is formed.

10. A fixing belt according to claim 8, in which said guides are formed on said elastic layer.

11. A fixing belt according to claim 8, in which said elastic layer consists of first, second and third elastic layers wherein the second elastic layer is made of a material that prevents releasing agent from permeating and barrier sections are formed to cover edges of at least the first elastic layer among the elastic layers, the edges being in a width direction thereof.

12. A fixing belt according to claim 8, in which said guides are made of an elastic material having a limited affinity with releasing agent and heat resistance and said elastic layer consists of first, second and third elastic layers wherein the second elastic layer is made of a material that prevents releasing agent from permeating and barrier sections are formed to cover edges of at least the first elastic layer among the elastic layers, the edges being in a width direction thereof.

13. The fixing belt according to claim 8, wherein the guide has a tapered cross-section.

14. The fixing belt according to claim 8, wherein the guides are formed on a surface of the elastic layer opposite to the belt-like metal base.

15. A fixing apparatus comprising:

a plurality of rollers;

an endless fixing belt that spans said rollers; and members that form a nip area to apply pressure to an outer surface of said fixing belt, said fixing belt including a belt-like base made of a metal or plastic material and an elastic layer with a thickness of 200 μm or more being formed on said base and comprising at least three layers.

16. A fixing apparatus according to claim 15, in which said elastic layer consisting of first, second and third elastic layers arranged in that order from the base, the second elastic layer made of a material that prevents releasing agent from permeating.

17. A fixing apparatus according to claim 16, in which the second elastic layer is made of fluorine-containing rubber.

18. A fixing apparatus according to claim 16, in which the first elastic layer has a greater thickness and a higher thermal conductivity than the third elastic layer.

19. A fixing apparatus according to claim 16, in which at least the first elastic layer among the elastic layers has barrier sections formed on edges thereof, the edges being in a width direction thereof.

* * * * *